United States Patent [19]

Tatro

[11] 4,369,828

[45] Jan. 25, 1983

[54] SUPPLEMENTAL WINDOW AND BLIND UNIT

[75] Inventor: Michael J. Tatro, Wausau, Wis.

[73] Assignee: Wausau Metals Corporation, Wausau, Wis.

[21] Appl. No.: 266,815

[22] Filed: May 26, 1981

[51] Int. Cl.[3] ..... A47H 1/00; E06B 3/32

[52] U.S. Cl. ..... 160/107

[58] Field of Search ..... 160/92, 107

[56] References Cited

U.S. PATENT DOCUMENTS

| | | | |
|---|---|---|---|
| 2,170,877 | 8/1939 | Simon | 160/107 |
| 2,249,641 | 7/1941 | Stucki | 160/107 |
| 2,631,339 | 3/1953 | Pratt . | |
| 2,849,762 | 9/1958 | McCarthy . | |
| 2,877,516 | 3/1959 | Bobel . | |
| 2,915,293 | 12/1959 | Berg . | |
| 2,976,583 | 3/1961 | McCarthy . | |
| 3,008,196 | 11/1961 | Springer et al. . | |
| 3,022,549 | 2/1962 | Cummings . | |
| 3,128,823 | 4/1964 | Klapstad . | |
| 3,291,193 | 12/1966 | Hagerty et al. | 160/107 |
| 3,326,267 | 6/1967 | Hauck | 160/107 |
| 3,366,159 | 1/1968 | Arnold et al. | 160/107 |
| 3,443,624 | 5/1969 | Tath . | |
| 3,534,800 | 10/1970 | Guttman | 160/92 |
| 3,703,920 | 11/1972 | Debs . | |

FOREIGN PATENT DOCUMENTS

| | | | |
|---|---|---|---|
| 2607937 | 9/1977 | Fed. Rep. of Germany | 160/107 |

*Primary Examiner*—Peter M. Caun

*Attorney, Agent, or Firm*—Isaksen, Lathrop, Esch, Hart & Clark

[57] ABSTRACT

A supplemental window and blind unit (10) adapted to be installed in a conventional window (13, 15) having a conventional frame (11) and an original window pane (26). A supplemental frame (28) is attached to the conventional frame (11), and a sash (36) is attached to the supplemental frame (28) in hinged relation. A supplemental window pane (34) is mounted in the sash (36) to close the framed window opening (29) defined by the supplemental frame (28). A window blind (46) is attached to a selected part of the sash (36) so that the window blind (46) is between the supplemental window pane (34) and the original window pane (26) when the sash (36) is in its closed position, whereby the conventional window (13, 15) may be modified to be a window having multiple panes with a window blind enclosed between two of the panes.

12 Claims, 6 Drawing Figures

SUPPLEMENTAL WINDOW AND BLIND UNIT

TECHNICAL FIELD

The present invention relates to multiple-glazed windows in general and, in particular, to multiple-glazed windows with a window blind disposed between two of the panes.

BACKGROUND OF ART

Many structures in the United States, and in particular commercial structures, have single-glazed windows. These windows were installed when costs of heating were low and before fuel shortages had made clear the need to conserve energy resources. In contrast, buildings now being constructed generally have double- or even triple-glazed windows. As a further measure to conserve energy, venetian blinds are sometimes employed in association with such windows. Window units having two or more glazings with a venetian blind located between the glazings are currently available for installation in new buildings or for refitting buildings having less energy efficient windows. The venetian blind structure serves both to decrease the loss of radiant energy through a window from a warm building in cold weather and to reduce the radiant energy entering a cool building in hot weather.

The cost of replacing inadequate single-glazed windows in an existing building is considerable. The old windows must be removed, frames repaired or replaced, and new windows installed. The process disrupts the use of the rooms in which the windows are located, leaves the building open to the weather for a period of time, and may even require cordoning off sidewalks or other areas beneath the windows in order to prevent the chance of injury to passersby from falling materials. As a consequence of all of these disadvantages, as well as the considerable expense of entirely new replacement windows, many inadequate single-glazed windows remain unimproved, adding to the energy problem of the country.

The prior art is generally cognizant of double-glazed windows having a window blind or sunscreen located between the glazings. For typical examples, see McCarthy, U.S. Pat. No. 2,849,762, and Requena, U.S. Pat. No. 3,324,620. Examples of the use of adjustable blinds of the venetian blind sort interposed between exterior and interior glazings are seen in Pratt, U.S. Pat. No. 2,631,339, Cummings, U.S. Pat. No. 3,022,549, Klopstad, U.S. Pat. No. 3,128,823, and Toth, U.S. Pat. No. 3,443,624. Sometimes provision is made for the entire, double-glazed window with the enclosed window blind to open, the window typically being hinged at one side, as in Pratt, or pivotted about some selected axis of the window, as in Toth.

The advantages of the structures shown in the prior art, either expressly discussed in the prior art or understood by implication, are the advantages offered by double-glazing in reducing thermal conduction through a window, and by enclosing a shade between panes of glass. The shade provides a substantial screening coefficient which greatly reduces solar radiation through the window while selectively permitting such radiation when additional interior heat is desired. The enclosed shade cannot be bumped or otherwise disturbed in normal use and will not collect dust. The double-glazed windows with blinds shown in the prior art are designed to be made and installed as complete units, to be used either in new construction or to entirely replace a conventional window when used in refitting an existing structure.

Debs, U.S. Pat. No. 3,703,920, shows a venetian blind adapted to be installed in a commercial double-glazed window of a particular metal frame construction that includes a framing channel along one edge of the space between the window panes, wherein the space is sufficiently wide to accommodate the shade. Thus, the double-glazed window construction is altered to include the energy saving benefits of the venetian blind.

The prior art windows make no provision for upgrading a previously installed, conventional single-glazed window so as to provide both an additional sealed window and, in combination therewith, a venetian blind mounted on the sash of the additional window and within the air space between the old and new window panes. Instead, when it has been necessary to upgrade existing structures to include energy efficient double-glazed windows with enclosed blinds, conventional structures and methods require removal of existing windows and replacement with entire new double-glazed units with enclosed venetian blinds. As a consequence, refitting an existing building with energy efficient windows typically requires extensive remodeling, expensive window and blind components, and considerable expense.

DISCLOSURE OF THE INVENTION

The present invention is summarized in that a supplemental window and blind unit is adapted to be installed in a previously installed conventional window unit having a conventional frame, the frame having surfaces defining a window opening, the previously installed window also having an original sash and window pane closing the window opening. The supplemental window and blind unit includes a supplemental peripheral frame indepedent from the original sash, adapted to be attached to selected surfaces of the conventional frame and extending around the periphery of the window opening and interiorly spaced from the original window pane, the supplemental window frame having surfaces defining a framed window opening. A sash is attached to the supplemental frame in hinged relation and has open and closed positions. A supplemental window pane is mounted in the sash whereby the sash and supplemental window pane close the framed window opening when the sash is in its closed position. A window blind is attached to a selected part of one of the sash and the supplemental peripheral frame so that the window blind is supported between the supplemental window pane and the original window pane when the sash is in its closed position.

A primary object of the invention is to provide a supplemental window and blind unit for selectively controlling the radiant energy transmission characteristics of windows already installed in a building by providing a substantial insulating air space and an adjustable shading means within the air space.

A second object of the invention is to reduce air leakage through an opening in a building closed by an existing window.

A further object of the invention is to provide the advantages of a multiple-glazed window, utilizing a previously installed window and a supplemental window and blind unit spaced substantially inwardly from the previously installed window, with the blind being supported between the two windows and adjustable from the interior of the living space enclosed by the multi-glazed window.

Another object of the invention is to provide the advantages of a multiple-glazed window having a window blind enclosed between panes of the window, utilizing an existing window unit with a supplemental window and blind unit inwardly spaced from the original window and mounted within the existing window frame in substantially air-tight relation.

Yet another object of the invention is to provide a nondisruptive, quick, and economical means for upgrading conventional window units by providing an additional window pane, tightly sealed to the conventional window frame and substantially spaced interiorly from the conventional window pane, and a window blind contained between the old and the new window panes in the upgraded window.

Other objects, features, and advantages of the invention will be apparent from the following detailed description taken in conjunction with the accompanying drawings showing a preferred embodiment of a supplemental window and blind unit exemplifying the principles of the invention.

DETAILED DESCRIPTION OF THE PREFERRED EMBODIMENT

Figure 1:
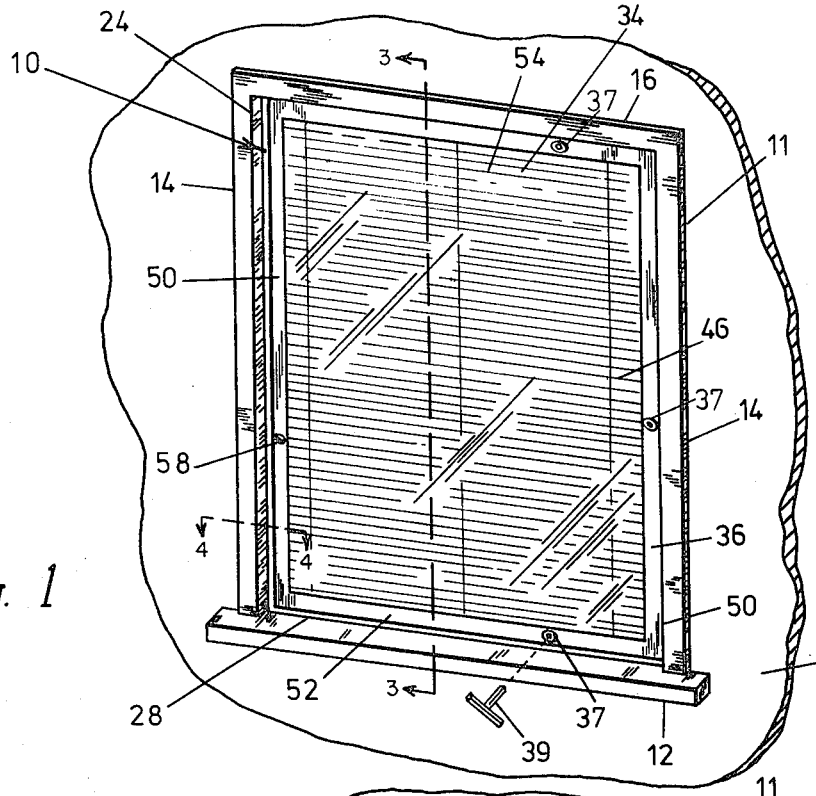
FIG. 1 is a perspective view of a supplemental window and blind unit made in accord with the invention and installed in a window.
Figure 2:
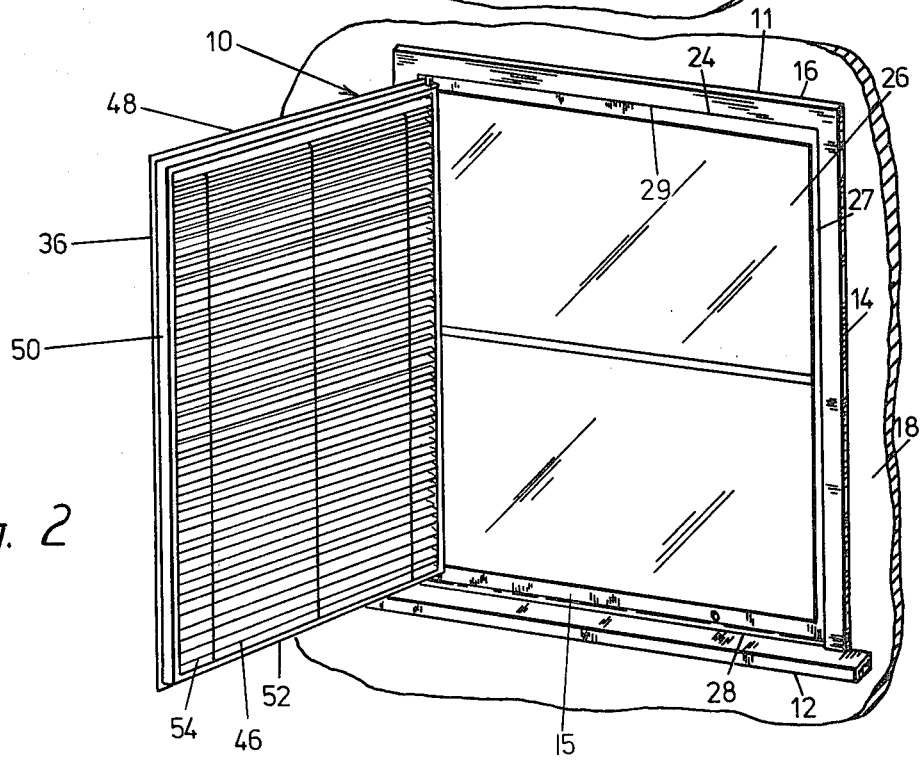
FIG. 2 is a perspective view of the supplemental window and blind unit shown in FIG. 1, with the supplemental pane in the open position.
Figure 3:
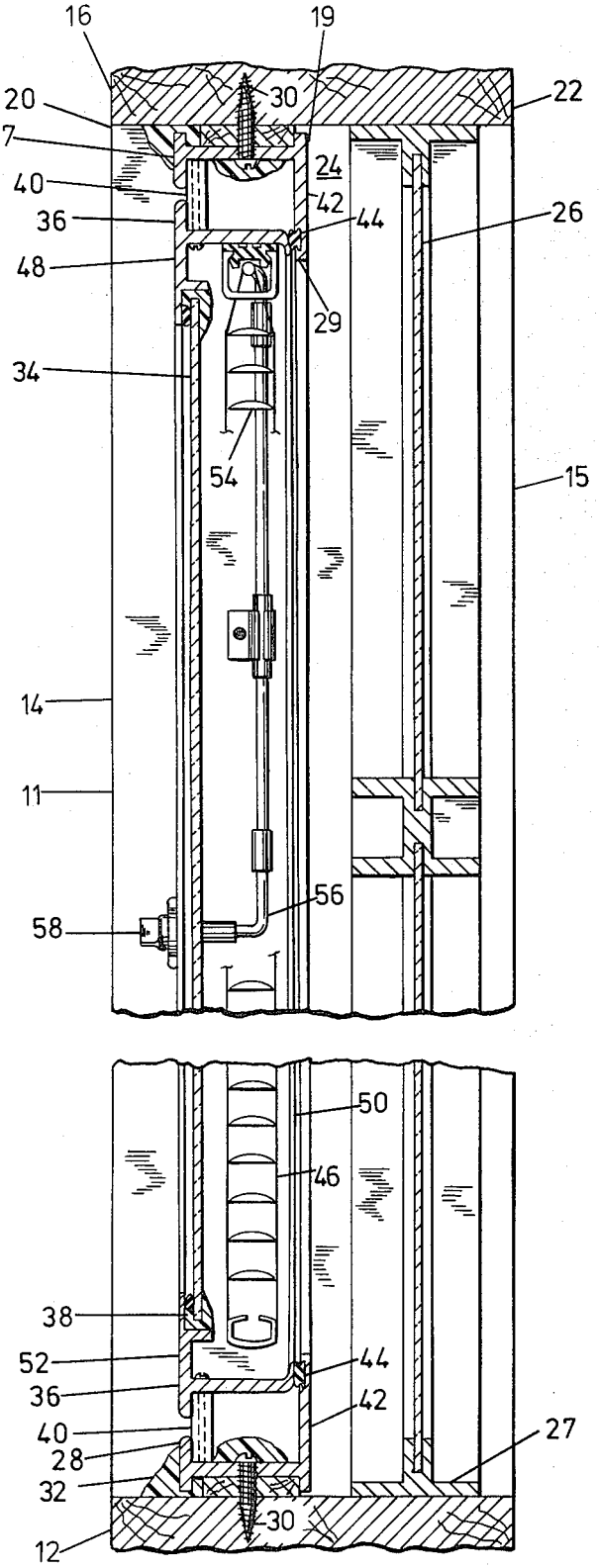
FIG. 3 is a cross-sectional view of the supplemental window and blind unit of the invention, taken along section lines 3—3 of FIG. 1.
Figure 4:
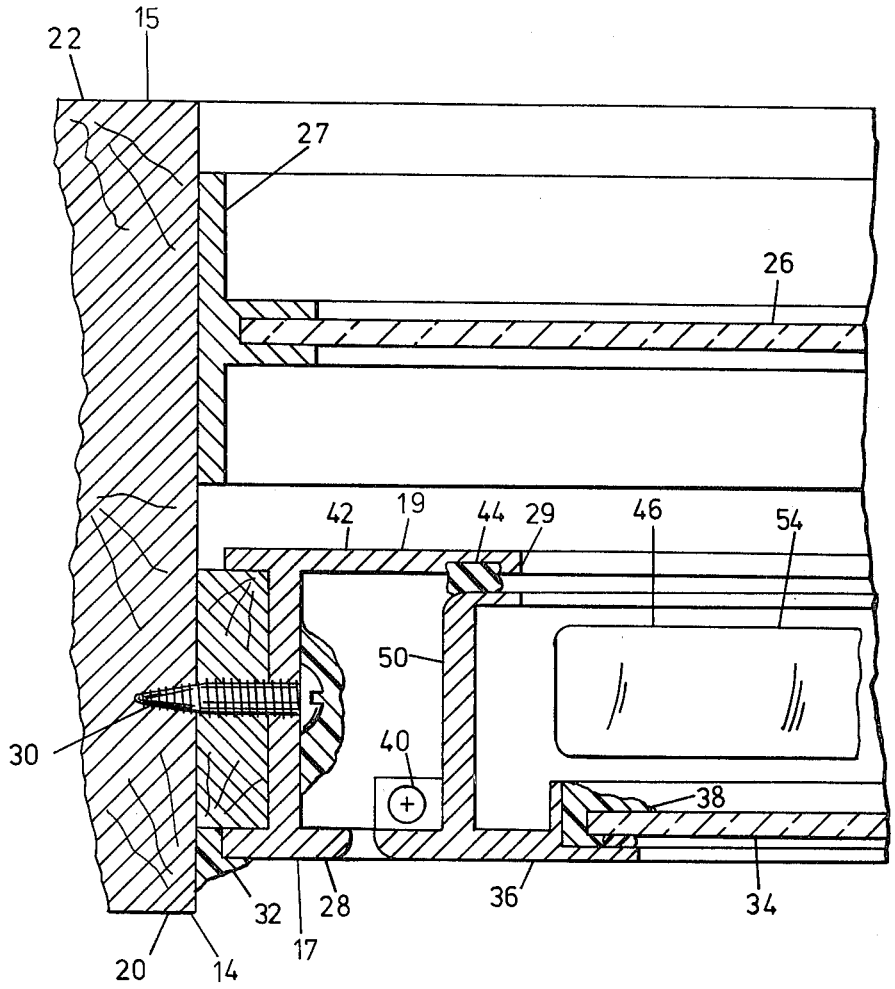
FIG. 4 is a cross-sectional view of a broken away part of the supplemental window and blind unit of the invention taken along section lines 4—4 of FIG. 1.
Figure 5:
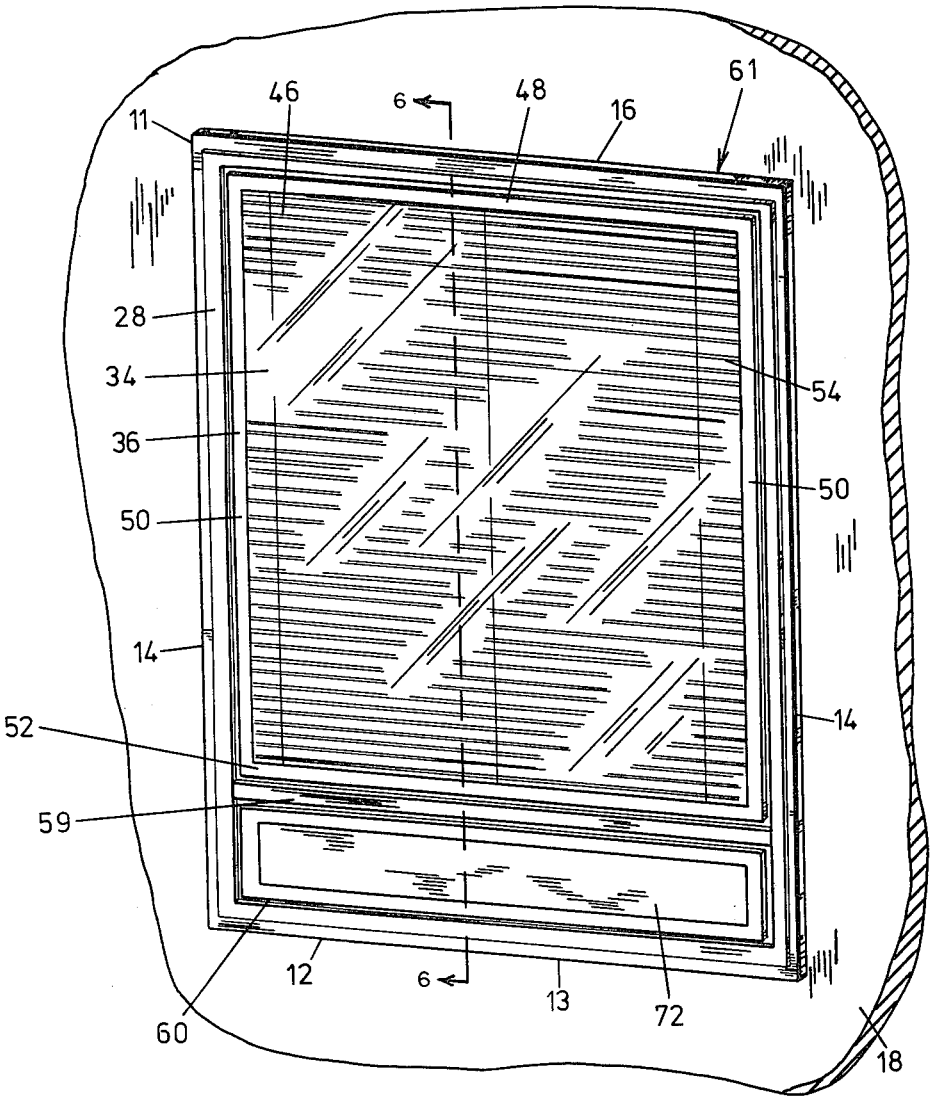
FIG. 5 is a perspective view of a supplemental window and blind unit made in accord with the invention, including a ventilation access panel.
Figure 6:
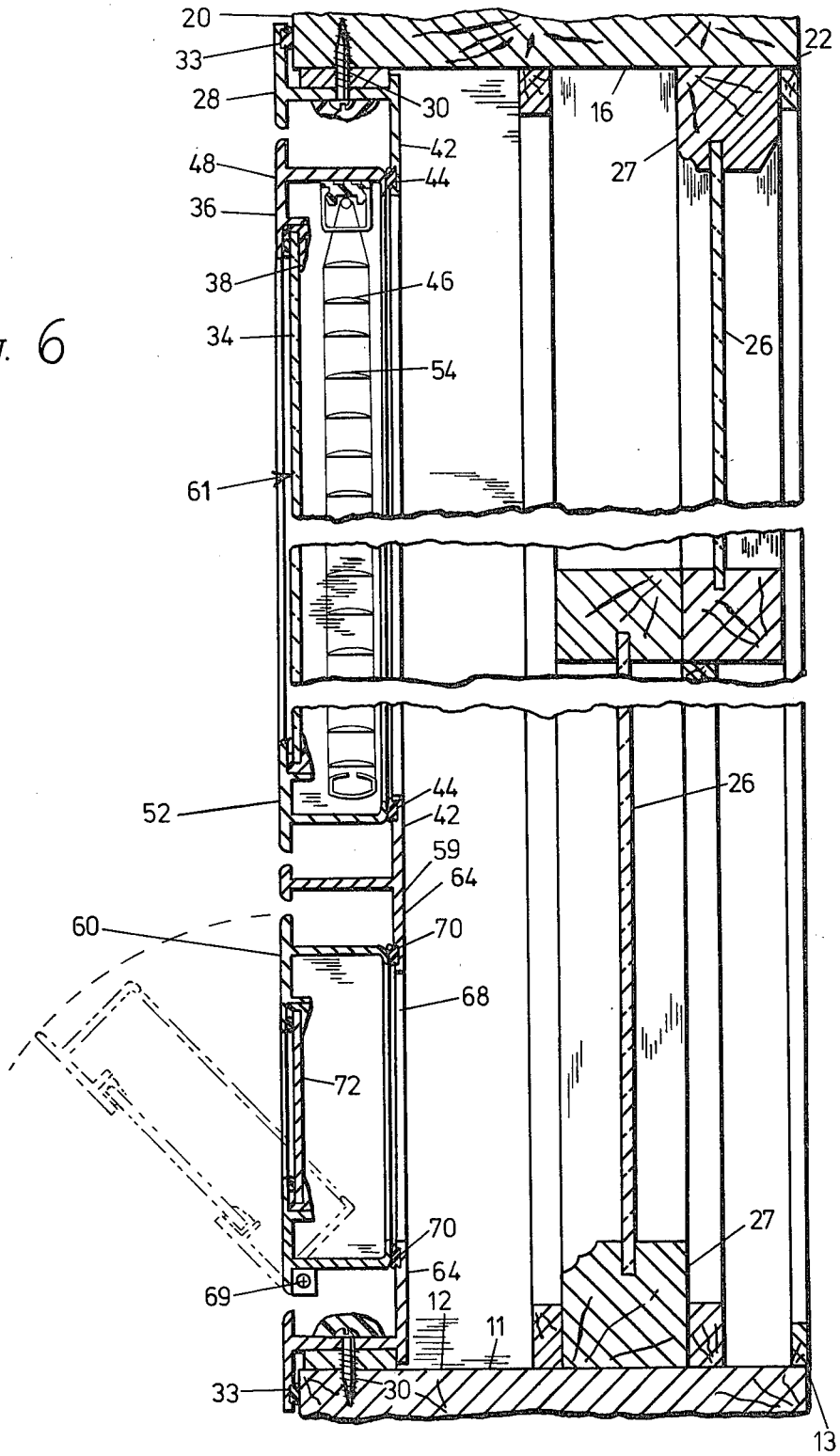
FIG. 6 is a cross-sectional view of the supplemental window and blind unit shown in FIG. 5, taken along section lines 6—6 of FIG. 5.

Referring more particularly to the drawings, wherein like numbers refer to like parts, FIGS. 1 and 2 illustrate a preferred embodiment of the novel supplemental window and blind unit of the invention, shown generally at 10. The supplemental window and blind unit 10 is adapted to be installed on the interior side of almost any conventional, previously installed window unit, such as the double hung conventional window unit shown at 13 in FIG. 6 and the non-opening conventional window unit shown at 15 in FIGS. 2, 3, and 4. Typically such conventional window units have an interior side 17 and an exterior side 19, a conventional frame 11, with a sill 12, opposed jambs 14, and a head member 16, as shown, corresponding parts of conventional windows 13 and 15 being given like numbers. The conventional frame 11 is installed in an opening in a wall 18 having an interior side 20 and an exterior side 22, so that the frame 11 and all of its parts have interiorly and exteriorly facing surfaces.

Surfaces of the conventional frame 11 define a window opening 24. The window opening 24 is closed by at least one original window pane 26 set in an original sash 27. For the purposes of this disclosure "original sash" shall be understood to include both movable and fixed window pane-holding frame members. The supplemental window and blind unit 10 of the invention will be utilized on the interior side of previously installed window units 13, 15 having one or more original window panes 26. In such conventional window units 13, 15, the original sash 27 may be weather-tight, but will frequently be inadequately equipped with weather stripping or may have warped with time, leading to undesirable air exchange between the exterior and interior sides of the window. It is generally expected that such conventional window units 13, 15 would be single-glazed, having only one original window pane 26. However, the supplemental window and blind unit 10 of the invention may be beneficially installed with conventional windows having two or more original window panes 26.

The supplemental window and blind unit 10 of the invention has a peripheral supplemental frame 28 that is attached to selected surfaces of the conventional frame 11 extending entirely around the periphery of the window opening 24. The supplemental unit 10 is spaced inwardly from the original sash 27 to provide a substantial air space between the old and the new windows. The supplemental frame 28 is attached in continuously abutting relation to the conventional frame 11 by any suitable, conventional fastener, such as the screws 30 shown in FIGS. 3 and 4. The supplemental frame 28 is substantially rigid and has a strength sufficient to support the weight of the remaining parts of the supplemental window 10 of the invention. Preferably the supplemental frame 28 is made of extruded aluminum. Caulking 32, the gasket 33 shown in FIG. 6, or some other suitable means for sealing substantially prevents the leakage of air between the conventional frame 11 and the supplemental frame 28.

The supplemental frame 28 has surfaces defining a framed window opening 29. A sash 36 is attached to the supplemental frame 28 in openable and preferably in hinged relation. A supplemental window pane 34 is mounted in the sash 36 and is secured thereto in air-tight relation by an appropriate, conventional caulking 38. Together with the sash 36, the supplemental window pane 34 closes the framed window opening 29. Preferably, hinges 40 are attached to a vertical portion of the supplemental frame 28 and are adapted to permit the sash 36 to be swung inwardly. Thus the sash 36 may assume either a closed position contiguous with the supplemental frame 28 or an open position, in which it is swung inwardly. Selected exteriorly facing parts of the sash 36 overlap selected interiorly facing surfaces of the supplemental frame 28 that serve as a stop to prevent movement of the sash 36 toward the original window pane 26 beyond a selected position. In the preferred embodiment, a stop member 42 is formed as a unitary part of the supplemental frame 28 and extends into the framed window opening 29 for a selected distance to a point where it is overlapped by the sash 36. However, other arrangements whereby the sash 36 and the supplemental frame 28 overlap each other so as to prevent the sash from moving beyond the supplemental frame toward the original window pane 26 would be within the scope and spirit of the invention.

In the preferred embodiment, a weather strip 44 is attached to a selected surface of the stop member 42 and is so oriented that it contacts the sash 36 in sealing relation when the sash is in its closed position. The coaction of the supplemental frame 28, the associated stop member 42, the weather strip 44, the caulking 32, the sash 36, and the supplemental window pane 34 mounted and sealed therein by means of the caulking 38 provides a weather-tight closure of the window opening 24, which closure in no way depends upon the weather-tight qualities of the original sash 27 or original window pane 26. The sash 36 may be held in its closed position by any suitable, conventional means for latching, such as magnetic latches, set screws, or by one or more latches 37, shown in FIG. 1, operated by a key 39 that can be removed so as to prevent unauthorized unlatching.

A window blind 46 is attached to selected surfaces of the sash 36. In the preferred embodiment, the uppermost portion of the sash 36 is formed by a sash head member 48. The sash 36 also has opposed sash side members 50 and a sash foot member 52 that forms the lowermost portion of the sash 36. In the preferred embodiment, the window blind 46 is attached to the sash head member 48 and depends therefrom, extending substantially to the sash foot member 52.

Preferably the window blind 46 is a conventional venetian blind having horizontal slats 54, as shown in FIGS. 1–6. The window blind 46 is adjustable in conventional fashion, with the angle of the slats 54 being adjustable and the entire blind being adapted to be drawn by conventional means upward toward the sash head member 48 to leave the framed window opening 29 substantially unobstructed thereby. The window blind 46 is controlled manually by a flexible cable 56 adapted to turn and thereby activate conventional control mechanisms for the window blind 46. The flexible cable 56 is located adjacent to the sash head member 48 and extends along a sash side member 50 for a selected distance. The flexible cable 56 extends through a suitable mounting to the interior side of the sash side member 50 and is turnable by a hand manipulated control knob 58. By this means, the window blind 46 may be conveniently adjusted with the sash 36 in the closed position.

Although the preferred embodiment includes the adjustable, venetian-type window blind 46 with horizontal slats 54 disclosed above, window blinds with vertically extending slats, non-adjustable window blinds, or any structure selected to provide the desired privacy or control of radiant energy transmission could be used as the window blind 46 within the scope and spirit of the invention.

When it is desirable to have access to the original window pane 26 without the necessity of opening the sash 36, an intermediate frame member 59 extends between exposed parts of the supplemental frame 28 to partition off from the framed window opening 29 an access opening portion 68. The location of the access opening portion 68 is selected to be opposite that part of the original window pane 26 to which access is desired. In the embodiment of the invention shown at 61 in FIGS. 5 and 6 (wherein parts that are the same as corresponding parts of the embodiment shown at 10 in FIGS. 1 and 2 are given the same reference numbers as those parts and are not separately described), an access opening portion 68 is shown beneath the sash foot member 52, extending parallel thereto.

An access panel 60 adapted to close the access opening portion 68 is fastened therein in openable relation. Preferably, the access panel 60 is hinged to a selected portion of the supplemental frame 28. The access panel 60 has an open position (shown in phantom in FIG. 6) and a closed position and is held in its closed position by any conventional means for latching such a structure, such as a magnetic or mechanical catch (not shown). Preferably the catch is selected so as to be readily released, providing a user of the panel 60 with convenient access through the access opening 68 to the original window pane 26. By this means, the conventional window 13 may be opened and ventilation obtained through the access opening 68 without having otherwise to disturb the supplemental window structure. The access panel 60 has a panel stop member 64 corresponding in function and preferably in structure to the stop member 42 of the supplemental frame 28, whereby the access panel 60 is prevented from swinging toward the original window pane 26 beyond a selected position.

The access panel 60 may be made of any suitably strong material and may have any selected rigid and air-tight structure. Preferably it is made out of parts otherwise structurally comparable to the sash head member 48, sash side members 50, and sash foot member 52 formed into the access panel 60 of selected dimensions, in which an opaque panel or pane of glass or other material of desired characteristics is mounted to form a panel inset 72. The panel inset 72 is fastened in the access panel 60 by the use of a conventional caulking in a manner generally comparable to that in which the supplemental window pane 34 is mounted in the sash 36, as disclosed above.

It will be apparent from the disclosure set forth above that the supplemental window and blind unit 10 of the invention is adapted to be applied to a conventional frame 11 from the interior side 20 thereof. Consequently, the supplemental window and blind unit 10 may be installed without need for inconvenient or dangerous operations on the exterior of the building in which the window is located. Furthermore, because the supplemental window and blind unit 10 may be installed interiorly to the original window pane 26, installation in inclement weather and at any season may be conveniently undertaken. Because the supplemental window and blind unit 10 of the invention may be applied to a conventional frame 11 with a minimum of modification thereof and without removal of the original window pane 26, a conventional window 13, 15 may be so altered as to better seal the window opening 24, an additional pane may be installed, and the appearance of the conventional window unit 13, 15 may be altered with a minimum of disruption of the use of the room in which the window is located.

Any air leaks in the conventional, previously installed window unit 13, 15 allow the space between the previously installed window unit and the supplemental window and blind unit 10 to breathe in response to changes in barometric pressure and thermally-caused changes in air pressure in the enclosed dead air space. The window opening 24 of the conventional frame 11 will be sealed by the supplemental window and blind unit 10, preventing air exchange between the interior and exterior sides 20, 22 thereof, notwithstanding such leaks.

Commonly the parts of the conventional frame 11 extending interiorly from the original sash 27 will be quite deep. Consequently, the supplemental frame 28 may usually be so installed that the dead air space between the existing window pane 26 and the supplemental window pane 34 is correspondingly deep without requiring that the supplemental frame 28, itself be extended outwardly in an excessively bulky or costly manner. The thermal insulating properties of such a dead air space improve with its depth, so that the supplemental window and blind unit 10 of the invention is adapted to allow an installation selected to take full advantage of the potential for improving the thermal insulating qualities of the previously installed window unit 13, 15. In addition, the noise insulating qualities of such a dead air space also improve with its depth. This fact is of significant importance in, for example, urban installations where street noise levels are high, making the sound insulating properties of the invention an appreciable advantage thereof. Furthermore, since the window blind 46 may be adjusted from the interior side of the supplemental window and blind unit 10 even when the sash 36 is in its closed position, such adjustments may be made with no compromising of the insulating dead air space.

The rigid parts that have been described above may be made from any suitable rigid material, such as wood, metal, or a suitable plastic, and may be made by conventional wood, metal, or plastic forming techniques. Preferably, the supplemental frame 28 and sash 36 are made of extruded aluminum, which is sufficiently strong, compact, light weight, and attractive to provide all of the desired benefits of the invention.

It is understood that the invention is not confined to the particular materials and embodiments herein illustrated and described, but embraces all such modified forms thereof as come within the scope of the following claims.

What is claimed is:

1. A supplemental insulating window and blind unit (10) adapted to be installed in a previously installed conventional window unit (13, 15) having a conventional fixed frame (11) with surfaces defining a window opening (24), and an original sash (27) and original window pane (26) closing the window opening (24), the supplemental window and blind unit (10) comprising:

(a) a supplemental peripheral frame (28) for closing the window opening (24) independent from the original sash (27), the supplemental window frame (28) having surfaces defining a framed supplemental window opening (29);

(b) means for fixedly and continuously attaching the supplemental peripheral frame (28) in air-tight sealing relation to surfaces of the conventional fixed frame (11) extending around the periphery of the window opening (24) and interiorly spaced from the original window pane (26);

(c) a sash (36) attached to the supplemental frame (28) in hinged relation and having open and closed positions;

(d) a supplemental window pane (34) mounted in the sash (36) whereby the sash (36) and supplemental window pane (34) close the framed supplemental window opening (29) when the sash (36) is in its closed position to create an insulating air space between the original window pane (26) and the supplemental window pane (34); and (e) a window blind (46) attached to a selected part of one of the sash (36) and the supplemental peripheral frame (28) so that the window blind (46) will be supported between the supplemental window pane (34) and the original window pane (26) when the sash (36) is in its closed position.

2. The supplemental window and blind unit (10) specified in claim 1 wherein:

(a) an intermediate frame member (59) extends between opposed parts of the supplemental frame (28) to partition off an access opening portion (68) of the framed window opening (29); and (b) an access panel (60) is adapted to engage the supplemental frame (28) and the intermediate frame member (59) to close the access opening portion (68) in air-tight relation, the access panel being openable for access to the conventional window unit (13, 15).

3. The supplemental window with blind unit (10) specified in claim 1 or 2 wherein the window blind (46) is a venetian blind having slats (54).

4. The supplemental window and blind unit (10) specified in claim 3 wherein the angle of the slats (54) may be adjusted so as to alter the radiant energy transmission qualities of the supplemental window and blind (10).

5. The supplemental window and blind unit (10) of claim 4 including means extending through one of the sash (36) and the supplemental peripheral frame (28) for adjusting the slats (54) while the sash (36) is in its closed position.

6. The supplemental window and blind unit (10) of claim 1 or 2 wherein the supplemental window and blind unit (10) has an interior side (17) and an exterior side (19) and wherein selected exteriorly facing parts of the sash (36) overlap selected interiorly facing surfaces of the supplemental frame (28), to prevent movement of the sash (36) toward the original window pane (26) beyond a selected closed position.

7. The supplemental window and blind unit (10) of claim 2 wherein the access panel (60) is attached to one of the supplemental frame (28) and the intermediate frame member (59) in hinged relation.

8. In combination, a previously installed conventional window unit (13, 15) having at least one original window pane (26) mounted in a conventional frame (11) that extends inwardly from the original window pane (26), and the improvement comprising, a supplemental insulating window and blind unit (10), the supplemental window and blind unit (10) having (a) a peripheral supplemental frame (28) fixedly attached to the conventional frame (11) and interiorly spaced from the original window pane (26) in substantially continuously abutting air-sealing relation, the supplemental frame (28) closing the window opening (24) and having surfaces defining a framed supplemental window opening (29);

(b) a sash (36) attached to the supplemental frame (28) in movable relation and having open and closed positions;

(c) a supplemental window pane (34) mounted in the sash (36) whereby the sash (36) and supplemental window pane (34) close the framed supplemental window opening (29) when the sash (36) is in its closed position to provide an enclosed insulating air space interiorly of the original window pane (26); and (d) a window blind (46) supported by the sash (36) and located between the supplemental window pane (34) and the original window pane (26) when the sash (36) is in its closed position to provide a between-the-window-panes blind.

9. The supplemental window and blind unit (10) of claim 8 including means extending through the sash (36) for adjusting the window blind (46) to alter the radiant energy transmission qualities of the supplemental window and blind (10) while the sash (36) is in its closed position.

10. The supplemental window and blind unit (10) of claim 8 or 9 wherein the sash (36) is attached to the supplemental frame (28) in hinged relation.

11. The supplemental window and blind unit (10) specified in claim 8 wherein:

(a) an intermediate frame member (59) extends between exposed parts of the supplemental frame (28) to partition off an access opening portion (68) from the rest of the framed window opening (29); and (b) an access panel (60) is adapted to close the access opening portion (68) in airtight, opening relation.

12. The supplemental window and blind unit (10) of claim 11 wherein the access panel (60) is attached to one of the supplemental frame (28) and the intermediate frame member (59) in hinged relation.

* * * * *